United States Patent [19]

Ikeda et al.

[11] Patent Number: 4,691,717

[45] Date of Patent: Sep. 8, 1987

[54] CIGARETTES

[75] Inventors: Sakio Ikeda, Nagareyama; Shozen Yonamine, Yokohama, both of Japan

[73] Assignees: Dynic Corporation, Kyoto; Mine Kinzoku Kogyo K.K., Kanagawa, both of Japan

[21] Appl. No.: 645,923

[22] Filed: Aug. 30, 1984

[30] Foreign Application Priority Data

May 4, 1984 [JP] Japan ..... 59-64744

[51] Int. Cl.[4] ..... A24D 1/02; A24D 1/10; A24D 1/12

[52] U.S. Cl. ..... 131/365; 131/349

[58] Field of Search ..... 131/349, 365

[56] References Cited

U.S. PATENT DOCUMENTS

| | | | |
|---|---|---|---|
| 3,030,963 | 4/1962 | Cohn | 131/349 |
| 3,220,418 | 11/1965 | Cohn | 131/349 |
| 4,231,377 | 11/1980 | Cline et al. | 131/365 |

*Primary Examiner*—V. Millin

*Attorney, Agent, or Firm*—Frishauf, Holtz, Goodman & Woodward

[57] ABSTRACT

The core of a cigarette is covered with a sheath made of material which does not generate any appreciable amount of smoke when the cigarette is sucked but burns when the cigarette is sucked. The material is made of starch, agar, gelatin or a mixture thereof.

56 Claims, 8 Drawing Figures

CIGARETTES

BACKGROUND OF THE INVENTION

This invention relates to a rod shaped core of tobacco (i.e.) a cigarette in which a cut leaf of a tobacco-plant is wrapped with a novel sheet.

With an increase in the number of non-smoking persons, the right of disliking cigarette smoke is becoming important.

In considering such social circumstances, the invention provides a cigarette less harmful to nearby people.

The smoke of a cigarette comprises a main stream of smoke which is sucked by a smoker through a sucking piece of the cigarette and an auxiliary smoke stream generated at the burning point. As is well known in the art, each stream contains harmful substances to human bodies, for example cancer inducing or accelerating substances.

In recent years, in addition to the harmuful effect to a smoker himself, harm to nearby non-smokers is a large social problem. As shown in the following table, the auxiliary smoke stream contains much more harmful substances than the main smoke stream so that harm to the nearby non-smokers is caused by the auxiliary smoke stream.

TABLE

| harmful substance | auxiliary smoke current/ main smoke current |
|---|---|
| tar | 2.1~3.4 |
| nicotine | 1.8~2.8 |
| benzo(a) pyrene | 3.9 |
| carbon monoxide | 4.7 |

See "Medical Science of Smoking" edited by Hirayama and Namiki, page 75, 1984 (pubilshed by Kodan Sha).

For preventing harm to the smoker himself, various filters are available on the market, and a number of research projects are now being conducted for decreasing the harm, and the harm to surrounding persons caused by the nearby smokers is now being discussed earnestly. As a result, trins have no smoking cars, no smoking seats are provided for in airplanes; and a no smoking space is provided in hospitals. Although various methods of decreasing the harm of the auxiliary smoke stream have been proposed, they have not yet been practiced and not investigated.

SUMMARY OF THE INVENTION

It is an object of this invention to provide a cigarette that does not generate any appreciable quantity of the auxiliary smoke stream.

Another object of this invention is to provide an improved sheet which does not generate smoke at the time when a cigarette is not sucked but burns at the time of sucking.

The auxiliary smoke stream is generated between sucking times, by the burning of the cigarette.

We have found that the generation of the auxiliary smoke stream can be substantially prevented by controlling the quantity of oxygen during the non-sucking period.

According to this invention, instead of using a conventional sheet of paper around the tobacco core, a sheet comprising a substance or a composition, which does not generates smoke during a non-sucking time but burns at the time of sucking, or a sheet with a portion thereof made of said substance or composition is used to wrap a cigarette. The cigarette thus prepared does not have an impaired taste and has a performance that controls the quantity of oxygen supplied, which could not be provided by a prior art cigarette, whereby the burning during the non-sucked period can be adjusted for preventing generation of the auxiliary smoke stream.

The sheet utilized in this invention can be prepared by coating or impregnating said substance or composition on one or both surfaces of a sheet of paper, or a portion thereof, or by laminating a sheet of said material or substance onto the entire surface of the sheet of paper or a portion thereof. The effect of decreasing the generation of the auxiliary smoke stream is influenced by the thickness of the sheet. In many cases, a thickness of more than 0.01 mm is desirable.

For the purpose of adjusting the burning of a cigarette, the sheet may be provided with regularly or irregularly spaced openings or perforations.

The substance or composition utilized in this invention that does not generate smoke at the time of not sucking but burns at the time of sucking comprises starch, gelatin, agar, a mixture of agar and starch, or mixtures thereof. These substances are preferred because they do not impair the taste of the cigarette. Especially a mixture of starch and a small quantity of agar is suitable.

An inorganic salt, for example, ammonium chloride or an organic acid, for example, citric acid and can be added to the substance.

To prepare a cigarette by wrapping a core of tobacco with a sheet of this invention, the whole core may be wrapped with the sheet. Alternatively, a portion of the core is wrapped with the sheet of this invention and the other portion is wrapped with an ordinary sheet of paper. In the latter case, a portion of a cigarette near the burning point must be wrapped with the sheet of this invention.

In summary, acording to this invention, there is provided a cigarette comprising a rod shaped tobacco core and a sheath surrounding the core, the sheath being made of material which does not generate any appreciable amount of smoke when the cigarette is not sucked but burns when the cigarette is sucked.

DESCRIPTION OF THE PREFERRED EMBODIMENT

Figure 1A:
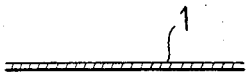
FIGS. 1A through 1D are sectional views showing various types of sheets utilized to wrap a cigarette.
Figure 1B:
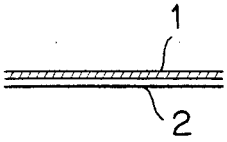
Figure 1C:
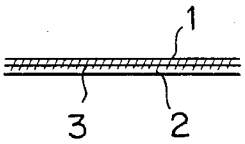
Figure 1D:
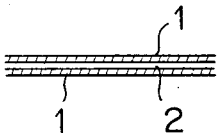

FIGS. 1A through 1D show various types of sheets utilized in this invention in which 1 designates a sheet of a substance of composition described above, for example a mixture of starch and agar, 2 a sheet of paper, and 3 the substance of composition impregnated into the sheet. Thus, FIG. 1A shows a sheet made up of the substance of composition alone. FIGS. 1B and 1D show laminations of the sheet 1 and the sheet of paper 2 to form multi-layered sheaths. The sheath in FIG. 1D comprises two sheets 1 on the opposite sides of the sheet of paper 2. In the case shown in FIG. 1C, one surface of the sheet of paper 2 is impregnated with the substance of composition 3 described above.

Figure 2:
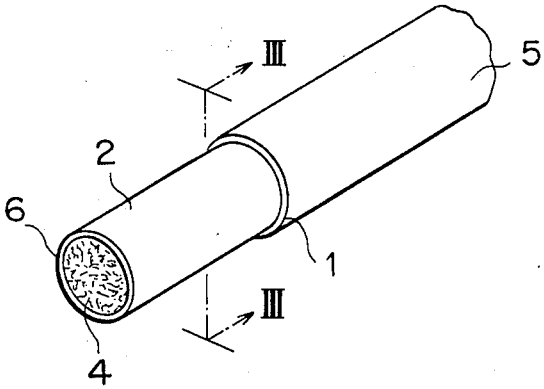
FIG. 2 is an enlarged perspective view showing one embodiment of the cigarette according to this invention.
Figure 3:
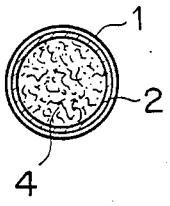
FIG. 3 is a cross-sectional view taken along a line III—III in FIG. 2.

In a cigarette shown in FIG. 2, a core made of a cut leaf 4 of a tobacco-plant is wrapped with a sheet of paper 2 at an end section 6 and the remaining portion is wrapped with the lamination shown in FIG. 1B. FIG. 3 shows a manner of wrapping the tobacco 4 with concentric sheets 1 and 2. In any case, the wrapped sheet or sheets constitute a sheath of the cigarette.

The cigarette of this invention is advantageous in that the major portion of the cigarette is wrapped with the specific substance of composition that does not generate any appreciable quantity of auxiliary smoke stream; that when a lighted cigarette is left as it is, the cigarette burns by only 1~2 mm; and that when the cigarette is not sucked during this time, the burning will not proceed further, whereby the danger of fire hazard can be prevented.

The sheet 1 may be of the same composition as a commercially available oblate. When oblate is used, a sheet thereof is wrapped about the tobacco 4 plant and confronting edges of the sheet are bonded together by applying water. Alternatively, an oblate in a molten state may be coated or sprayed onto the tobacco and then dried.

Figure 4:
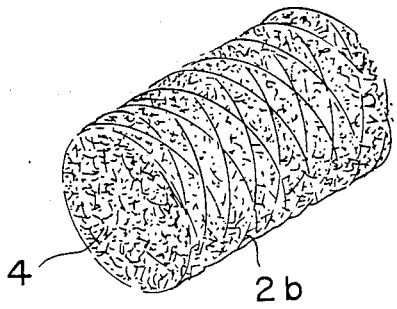
FIG. 4 is a perspective view showing a portion of a modified cigarette embodying the invention.

In a modification shown in FIG. 4, an oblate in the form of a cord of thread **2*b* is tightly wound on the tobacco 4**. As has been pointed out hereinbefore, a filter of the well known construction may be connected to one end of the cigarette.

If desired, a combustion promoting agent, a moisture preventing agent, dye, filler, etc. may be added to the oblate so long as they do not produce harmful smoke.

Figure 5:
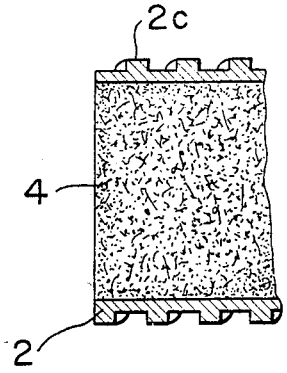
FIG. 5 is an enlarged longitudinal sectional view of a portion of another modified cigarette according to this invention.

In still another modification, an oblate consisting of a mixture of agar and starch is applied onto the tobacco 4 as a thin cylinder 2 provided with a helical ribs **2*c* to assist gripping, as shown in FIG. 5**.

Since starch and agar are hydrocarbon foodstuffs, they do not contain any harmful constituents so that they do not generate any harmful smoke.

We claim:

1. A cigarette comprising:

a rod shaped core made up of tobacco; and a perforated sheath surrounding said core and extending along at least a portion of the axial length of said core, said perforated sheath having a helical rib on the outer surface thereof;

said perforated sheath being comprised of a material extending along said portion of said axial length of said core and which generates substantially less smoke when the cigarette is not sucked than when the cigarette is sucked.

2. The cigarette of claim 1, wherein said sheath extends along at least a major portion of the axial length of said core.

3. The cigarette of claim 1, wherein said sheath extends along the entire length of said core.

4. The cigarette of claim 1, wherein said sheath is a multi-layered sheath, one layer thereof being a layer of said material and another layer thereof being a sheet of paper.

5. The cigarette of claim 4, wherein said material is a mixture of starch and agar.

6. The cigarette of claim 4, wherein said paper sheet is the inner layer of said multi-layered sheath, and said layer of said material is the outer layer of said cigarette.

7. The cigarette of claim 6, wherein said multi-layered sheath comprises a second layer of said material arranged underneath said sheet of paper.

8. The cigarette of claim 4, wherein said material is selected from the group consisting of starch, agar, gelatin and mixtures thereof.

9. The cigarette of claim 1, wherein said material is selected from the group consisting of starch, agar, gelatin and mixtures thereof.

10. The cigarette of claim 1, wherein said material is a mixture of starch and agar.

11. The cigarette of claim 1, wherein said material comprises a coating layer applied to said core.

12. The cigarette of claim 1, wherein said material comprises a spray-impregnated layer of said material on said core.

13. The cigarette of claim 1, wherein said sheath comprises a cord of said material helically wrapped around said core.

14. A cigarette comprising:

a rod shaped core made up of tobacco; and a sheath surrounding said core and extending along at least a portion of the axial length of said core, said sheath having a helical rib on the outer surface thereof;

said sheath being a multi-layered sheath including at least two superposed layers extending along a portion of the axial length of said core, one of said layers comprising a layer of a material which generates substantially less smoke when the cigarette is not sucked than when the cigarette is sucked, and another of said layers of said multi-layered sheath comprising a sheet of paper.

15. The cigarette of claim 14, wherein said sheath extends along at least a major portion of the axial length of said core.

16. The cigarette of claim 14, wherein said sheath extends along the entire length of said core.

17. The cigarette of claim 14, wherein said paper sheet is the inner layer of said multi-layer sheath, and said layer of said material is the outer layer of said cigarette.

18. The cigarette of claim 17, wherein said material is a mixture of starch and agar.

19. The cigarette of claim 17, wherein said multi-layered sheath comprises a second layer of said material arranged underneath said sheet of paper.

20. the cigarette of claim 17, wherein said material is selected from the group consisting of starch, agar, gelatin and mixtures thereof.

21. The cigarette of claim 14, wherein said material is selected from the group consisting of starch, agar, gelatin and mixtures thereof.

22. The cigarette of claim 14, wherein said material is a mixture of starch and agar.

23. The cigarette of claim 14, wherein said layer of said material comprises a spray-impregnated layer of said material on said core.

24. The cigarette of claim 14, wherein said sheath comprises a cord of said material helically wrapped around said core.

25. A cigarette comprising:

a rod shaped core made up of tobacco; and a perforated sheath surrounding said core and extending along at least a portion of the axial length of said core;

said perforated sheath being comprised of a material extending along said portion of said axial length of said core and which generates substantially less smoke when the cigarette is not sucked than when the cigarette is sucked; and said perforated sheath being a multi-layered sheath, first and second layers of said sheath being respective layers of said material and another layer of said sheath being a sheet of paper, one of said layers of said material being the outer layer of said cigarette, said sheet of paper being underneath said outer layer of said cigarette, and said other of said layers of said material being arranged underneath said sheet of paper.

26. The cigarette of claim 25, wherein said sheath extends along at least a major portion of the axial length of said core.

27. The cigarette of claim 25, wherein said sheath extends along the entire length of said core.

28. A cigarette comprising:

a rod shaped core made up of tobacco; and a perforated sheath surrounding said core and extending along at least a portion of the axial length of said core;

said perforated sheath being comprised of a material extending along said portion of said axial length of said core and which generates substantially less smoke when the cigarette is not sucked than when the cigarette is sucked; and wherein said material is selected from the group consisting of starch, agar, gelatin and mixtures thereof.

29. The cigarette of claim 28, wherein said material is a mixture of starch and agar.

30. The cigarette of claim 28, wherein said sheath is a multi-layered sheath, one layer thereof being a layer of said material and another layer thereof being a sheet of paper.

31. The cigarette of claim 30, wherein said paper sheet is the inner layer of said multi-layered sheath, and said layer of said material is the outer layer of said cigarette.

32. The cigarette of claim 31, wherein said multi-layered sheath comprises a second layer of said material arranged underneath said sheet of paper.

33. The cigarette of claim 31, wherein said material is a mixture of starch and agar.

34. The cigarette of claim 28, wherein said sheath extends along at least a major portion of the axial length of said core.

35. The cigarette of claim 28, wherein said sheath extends along the entire length of said core.

36. The cigarette of claim 28, wherein said material comprises a coating layer applied to said core.

37. The cigarette of claim 28, wherein said material comprises a spray-impregnated layer of said material on said core.

38. The cigarette of claim 28, wherein said sheath comprises a cord of said material helically wrapped around said core.

39. A cigarette comprising:

a rod shaped core made up of tobacco; and a perforated sheath surrounding said core and extending along at least a portion of the axial length of said core;

said perforated sheath being comprised of a material extending along said portion of said axial length of said core and which generates substantially less smoke when the cigarette is not sucked than when the cigarette is sucked; and said perforated sheath comprising a cord of said material helically wrapped around said core.

40. A cigarette comprising:

a rod shaped core made up of tobacco; and a sheath surrounding said core and extending along at least a portion of the axial length of said core;

said sheath being a multi-layered sheath including at least three superposed layers extending along a portion of the axial length of said core, two of said layers each comprising a layer of a material which generates substantially less smoke when the cigarette is not sucked than when the cigarette is sucked, and another of said layers of said multi-layered sheath comprising a sheet of paper;

one of said layers of said material being the outer layer of said cigarette, said sheet of paper being underneath said outer layer of said cigarette, and the other of said layers of said material being arranged underneath said sheet of paper.

41. The cigarette of claim 40, wherein said sheath extends along at least a major portion of the axial length of said core.

42. The cigarette of claim 40, wherein said sheath extends along the entire length of said core.

43. The cigarette of claim 40, wherein said material is selected from the group consisting of starch, agar, gelatin and mixtures thereof.

44. The cigarette of claim 40, wherein said material is a mixture of starch and agar.

45. The cigarette of claim 40, wherein at least one of said layers of said material comprises a spray-impregnated layer of said material on said core.

46. The cigarette of claim 40, wherein the inner most layer of said sheath comprises a cord of said material helically wrapped around said core.

47. A cigarette comprising:

a rod shaped core made up of tobacco; and a sheath surrounding said core and extending along at least a portion of the axial length of said core;

said sheath being a multi-layered sheath including at least two superposed layers extending along a portion of the axial length of said core, one of said layers comprising a layer of a material which generates substantially less smoke when the cigarette is not sucked than when the cigarette is sucked, and another of said layers of said multi-layered sheath comprising a sheet of paper; and wherein said material is selected from the group consisting of starch, agar, gelatin and mixtures thereof.

48. The cigarette of claim 47, wherein said material is a mixture of starch and agar.

49. The cigarette of claim 47, wherein said sheath extends along at least a major portion of the axial length of said core.

50. The cigarette of claim 47, wherein said sheath extends along the entire length of said core.

51. The cigarette of claim 47, wherein said paper sheet is the inner layer of said multi-layer sheath, and said layer of said material is the outer layer of said cigarette.

52. The cigarette of claim 51, wherein said material is a mixture of starch and agar.

53. The cigarette of claim 47, wherein said sheath comprises a cord of said material helically wrapped around said core.

54. The cigarette of claim 53, wherein said material is a mixture of starch and agar.

55. The cigarette of claim 47, wherein said layer of said material comprises a spray-impregnated layer of said material on said core.

56. A cigarette comprising:

a rod shaped core made up of tobacco; and a sheath surrounding said core and extending along at least a portion of the axial length of said core;

said sheath being a multi-layered sheath including at least two superposed layers extending along a portion of the axial length of said core, one of said layers comprising a layer of a material which generates substantially less smoke when the cigarette is not sucked than when the cigarette is sucked, and another of said layers of said multi-layered sheath comprising a sheet of paper; and wherein said sheath comprises a cord of said material helically wrapped around said core.

* * * * *